US006769511B1

(12) United States Patent
Brooks et al.

(10) Patent No.: US 6,769,511 B1
(45) Date of Patent: Aug. 3, 2004

(54) VARIABLE TUNED EXHAUST SYSTEM

(75) Inventors: Norman Brooks, Oshawa (CA); Doru N. Serban, Richmond Hill (CA)

(73) Assignee: General Motors of Canada Limited, Oshawa (CA)

( * ) Notice: Subject to any disclaimer, the term of this patent is extended or adjusted under 35 U.S.C. 154(b) by 0 days.

(21) Appl. No.: 10/368,897

(22) Filed: Feb. 18, 2003

(51) Int. Cl.[7] ..... F01N 7/18
(52) U.S. Cl. ..... 181/241; 181/212
(58) Field of Search ..... 181/241, 240, 181/138, 175, 212; 280/124

(56) References Cited

U.S. PATENT DOCUMENTS 2,403,699 A * 7/1946 Wilson ..... 181/241
5,475,189 A * 12/1995 Field et al. ..... 181/241
5,692,374 A * 12/1997 Seki et al. ..... 60/312
5,785,014 A * 7/1998 Cornwell ..... 123/65 PE
5,921,081 A * 7/1999 Kim ..... 60/324
6,457,553 B1 * 10/2002 Goplen et al. ..... 181/272

* cited by examiner

*Primary Examiner*—Shih-Yung Hsieh
(74) *Attorney, Agent, or Firm*—Laura C. Hargitt

(57) ABSTRACT

A muffler includes a housing having an inlet, an outlet, and at least one variable resonance chamber defined by a slidable member. The slidable member may be actuated by the pressure of exhaust gas flowing through the housing. Actuation of the slidable member changes the length of the resonance chamber, which alters the resonance and/or the flow path of the exhaust to provide varying tuning for acoustic damping.

13 Claims, 4 Drawing Sheets

VARIABLE TUNED EXHAUST SYSTEM

TECHNICAL FIELD

This invention relates to automotive vehicle mufflers and methods of reducing engine exhaust noise.

BACKGROUND OF THE INVENTION

Exhaust mufflers have been used in automotive applications to reduce engine exhaust noise and smooth exhaust-gas pulsations. Traditional mufflers may consist of a series of fixed expansion or resonance chambers of varying lengths connected together by pipes. The exhaust noise reduction is determined by the size and shape of the expansion chambers. Additional expansion chambers may be added to reduce exhaust noise; however, the additional chambers increase exhaust backpressure. Mufflers may also include sound deadening material which dampens sound over a broad band of higher frequencies. Consequently, lower sound frequencies are not reduced.

SUMMARY OF THE INVENTION

The present invention provides a muffler having a variable length resonance chamber. The variable chamber is defined by a slidable member that is slidable to vary the volume and length of the chamber. Changing these characteristics of the chamber tunes the muffler to provide variable acoustic resonance, while maintaining exhaust efficiency. The interior of the muffler may be divided into two or more resonance chambers. A spring or other biasing member preferably urges the slidable member toward an initial position from which it is moved by increasing exhaust flow pressure. Alternatively, other means for moving or positioning the slidable member may be utilized.

At idle, engine noise is nominal; therefore the muffler is only required to provide minimal sound dampening. At this speed, the slidable member is positioned to provide minimal noise reduction and maximum flow efficiency. As engine speed increases, additional exhaust gas flows into the muffler. The increasing gas flow pressure actuates the slidable member, against the spring force, thereby increasing the length of the resonance chamber and changing the flow path of the exhaust gas. The increased length in the resonance chamber improves acoustic cancellation, which reduces the intensity of the exhaust noise. As engine speed and exhaust noise are reduced, the biasing device moves the slidable member back toward its original position. This decreases the length of the resonance chamber, which reduces acoustic cancellation and decreases backpressure in the muffler.

These and other features and advantages of the invention will be more fully understood from the following description of certain specific embodiments of the invention taken together with the accompanying drawings.

DESCRIPTION OF THE PREFERRED EMBODIMENT

Figure 1:
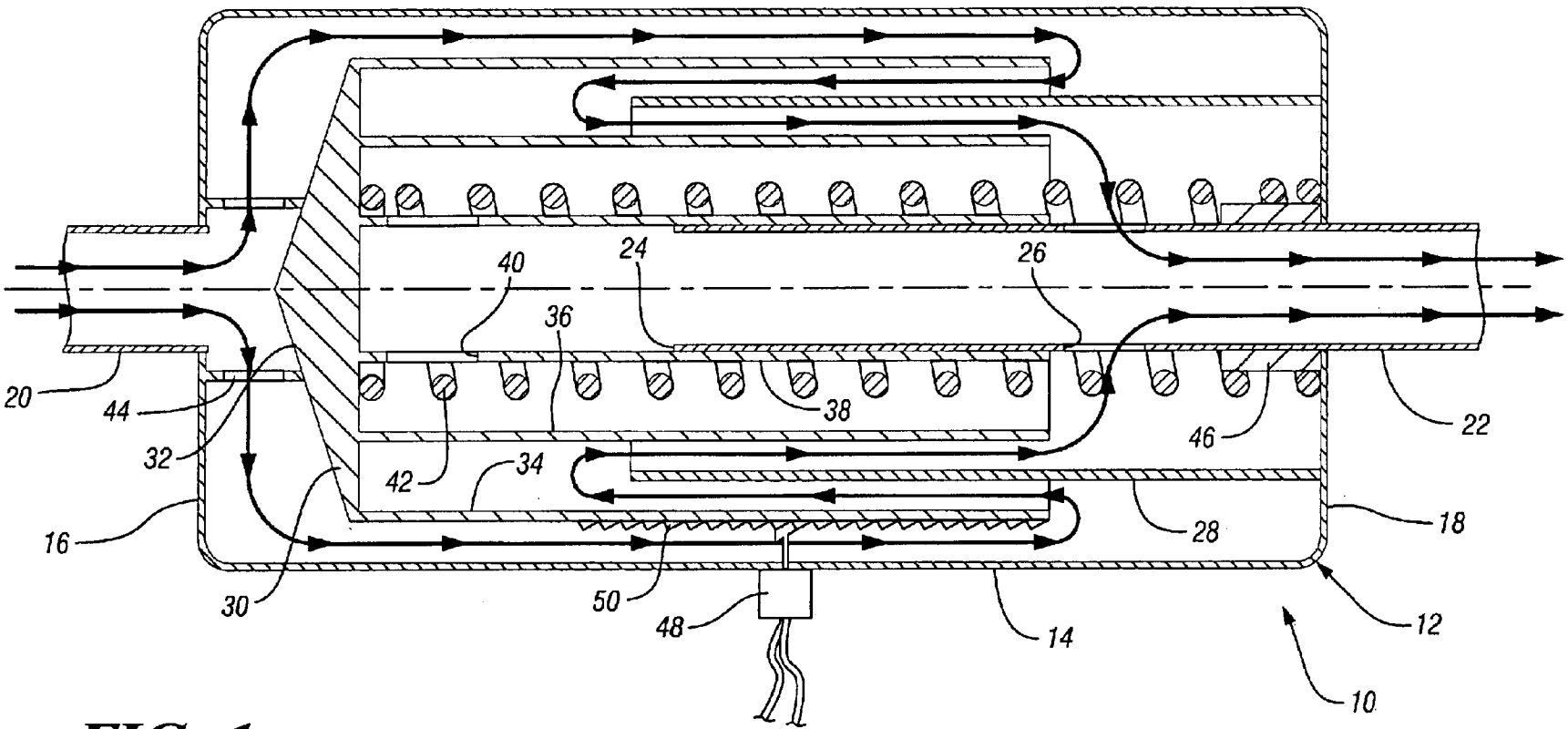
FIG. 1 is an axial cross-sectional view of a first embodiment of muffler shown in an idle operating position.
Figure 2:
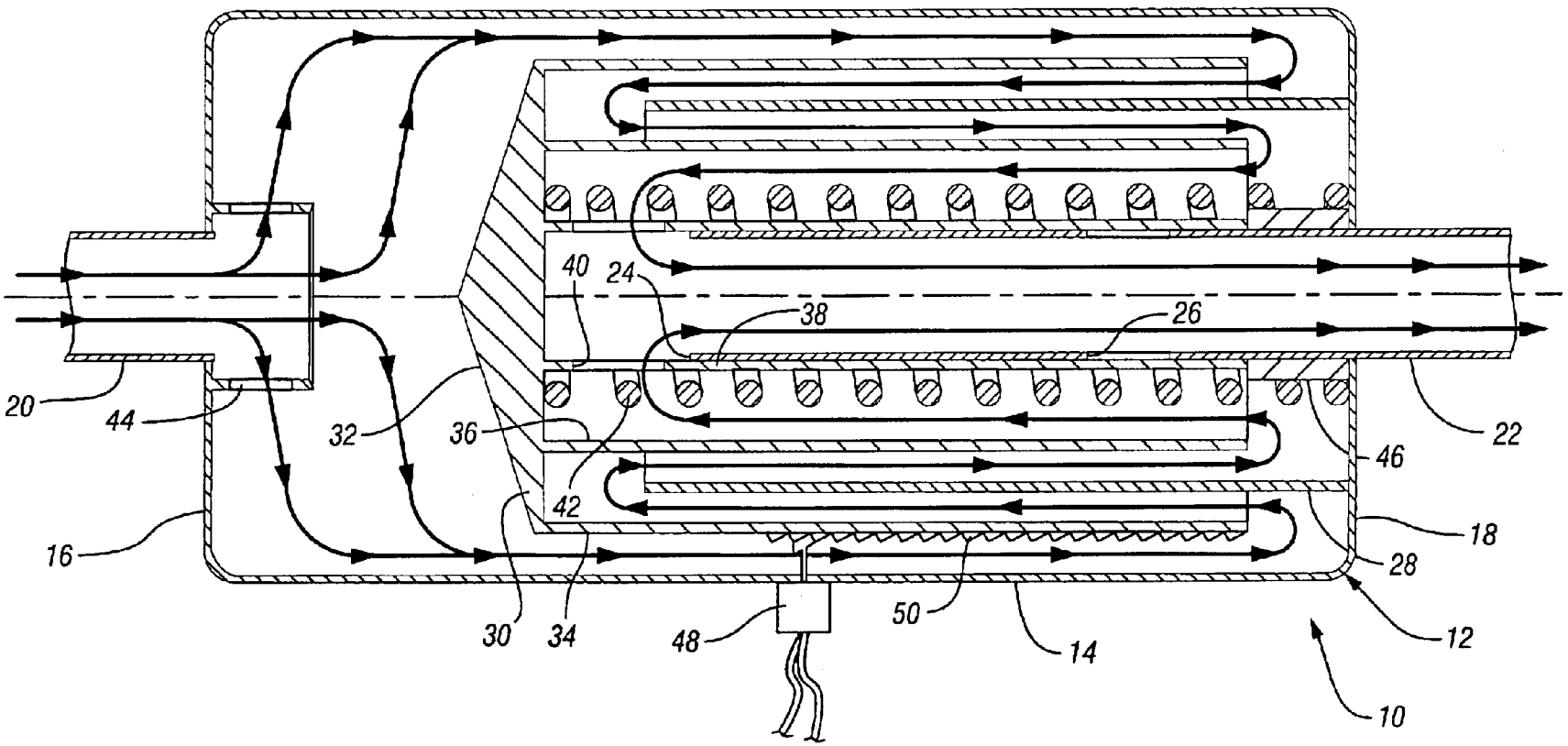
FIG. 2 is an axial cross-sectional view similar to FIG. 1 but showing the muffler in a high flow operating position.

Referring now to FIGS. 1 and 2 of the drawings in detail, numeral 10 generally indicates a first embodiment of automotive muffler according to the invention. The muffler includes a housing 12 having an outer wall 14 and inlet and outlet end walls 16, 18. An inlet pipe 20 extends axially through the inlet end wall 16 and an outlet pipe 22 extends through the outlet end wall 18. Outlet pipe 22 protrudes axially into the housing 12 to a point about midway between the end walls 16, 18. Outlet pipe 22 is open at an inner end 24 and is otherwise imperforate except for one or more bypass ports or idle outlet holes 26 located near the outlet end wall 18. A stationary housing baffle 28 extends inward from the outlet end wall 18, concentrically between the outer wall 14 and the outlet pipe 22, ending at a point near the inner end 24 of the outlet pipe 22.

A slidable member 30 is located inside the housing 12 and is longitudinally slidable on the outlet pipe 22. The slidable member 30 includes an inlet wall 32, which may have an angled face for directing exhaust flow around the member. Three concentric baffles 34, 36, 38 extend longitudinally from the back of inlet wall 32 toward the outlet end wall 18 of the housing 12. The outer baffle 34 extends between the housing 12 and the outer wall 14 and the housing baffle 28. The intermediate baffle 36 extends between the housing baffle 28 and the inner baffle 38. The inner baffle 38 is slidable fitted over the outlet pipe 22. Pipe 22 provides support for the slidable member 30 and allows for longitudinal movement in the housing 12. Adjacent the inlet wall 16 the inner baffle 38 includes outlet openings 40 connecting with the inner end 24 of the outlet pipe 22. The outer wall 14, the four concentric baffles 34, 28, 36, 38 and the outlet pipe 22 are spaced and overlapped to form a series of concentric exhaust flow channels.

While the embodiment of FIGS. 1 and 2 shows four baffles, the number of baffles can be changed to obtain the desired flow distance and noise reduction. It is clear that the baffles and other components could be formed in any desired shape, including oval and rectangular. Preferably, the number of baffles in the muffler will be adequate to provide acoustic cancellation to reduce the exhaust wave length to one quarter of its original length.

A spring 42, or other biasing device, biases the slidable member 30 toward the inlet end 16 of the housing 12. As shown, the spring 42 extends longitudinally inside the housing 12 between the outlet end wall 18 of the muffler and the inlet wall 32 of the slidable member 30.

An idle stop 44 is mounted on the inlet end 16 wall of the housing 12 to prevent the slidable member 30 from over traveling or closing the inlet pipe 20. Alternatively, the idle stop 44 may be mounted on the slidable member 30. The stop maybe formed of pins or any other object which has openings to avoid obstruction of exhaust gas flow. A high flow stop 46 may be mounted at the outlet end 18 of the housing 12, such as around the outlet pipe 22, to prevent blocking of exhaust flow by the slidable member 30.

A locking mechanism 48 is provided which engages teeth 50 on the outer most baffle 34 of the slidable member 30 to fix the longitudinal position of the slidable member as desired during operation.

In operation, the slidable member 30 is preferably moved longitudinally by the pressure of exhaust gas flowing into the muffler and acting on the inlet wall 32 against the return force of spring 42. Alternatively, actuation of the slidable member 30 may be accomplished by any suitable mechanism and control arrangement, for example by means of electronically controlled motorized actuators or other means as may be considered desirable and feasible.

FIG. 1 shows the muffler under idle exhaust flow conditions. During idle, the slidable member 30 is biased against the idle stop 44. In this position, exhaust gas flows around the slidable member 30 to the end of the outer baffle 34. It then flows back around the inner end of the stationary housing baffle 28 and through the idle outlet holes 26 into the outlet pipe 22. As engine speed increases, exhaust flow through the muffler also increases. The increased flow creates pressure, which acts on the inlet wall 32 of the slidable member 30, urging it toward the outlet end wall 18 of the housing 12, and compressing the biasing spring 42.

As the slidable member 30 moves from the idle position of FIG. 1, the inner baffle 38 increasingly closes the idle outlet holes 26, causing the exhaust gas to follow a longer flow path around the end of the intermediate baffle 36 to the outlet opening 40 in the inner baffle 38. The exhaust gas then flows into the outlet pipe 22 and out of the housing 12. The increased length of the flow path provides additional noise cancellation. Preferably, the slidable member 30 is actuated so that the resonance chamber causes the exhaust to resonate at a frequency of one quarter its original frequency.

As the slidable member 30 is actuated by the exhaust gas, the locking mechanism 48 engages the member 30 and locks it into place at a point where the exhaust gas resonates at approximately one quarter its original frequency. As exhaust pressure changes, the locking mechanism 48 allows the slidable member 30 to further actuate and change the amount of acoustic cancellation as needed. When engine speed is decreased or at idle, the locking mechanism 48 disengages the slidable member 30 and the biasing device 42 returns the slidable member 30 to its starting point.

The locking of the slidable member 30 may be accomplished by any suitable mechanism and control arrangement, for example by means of electronically controlled motorized actuators or other means as may be considered desirable and feasible. Other forms of locking devices such as a ratchet, a mechanical stepper, a worm gear, or a ball screw, could be substituted for those indicated with respect to the illustrated embodiments without departing from the concepts embodied in the invention as subsequently defined.

When the slidable member 30 is moved away from the idle position, the baffles increase the flow distance between the inlet pipe 20 and the outlet pipe 22. Specifically, for each unit the slidable member 30 is moved by exhaust gas, the flow path is increased two units when the outlet pipe 22 idle outlet holes 26 are open as shown in FIG. 1. When the idle outlet, holes 26 are closed, as shown in FIG. 2, for every additional unit the slidable member 30 is moved, the flow path is increased by four units. The number of baffles determines the distance of the exhaust flow path. The flow path increases as the number of baffles increases. However, additional baffles only increase the flow path when the idle outlet holes are closed. If the holes are open only the outermost baffles affect the exhaust flow path, because the exhaust bypasses the inner baffles.

Figure 3:
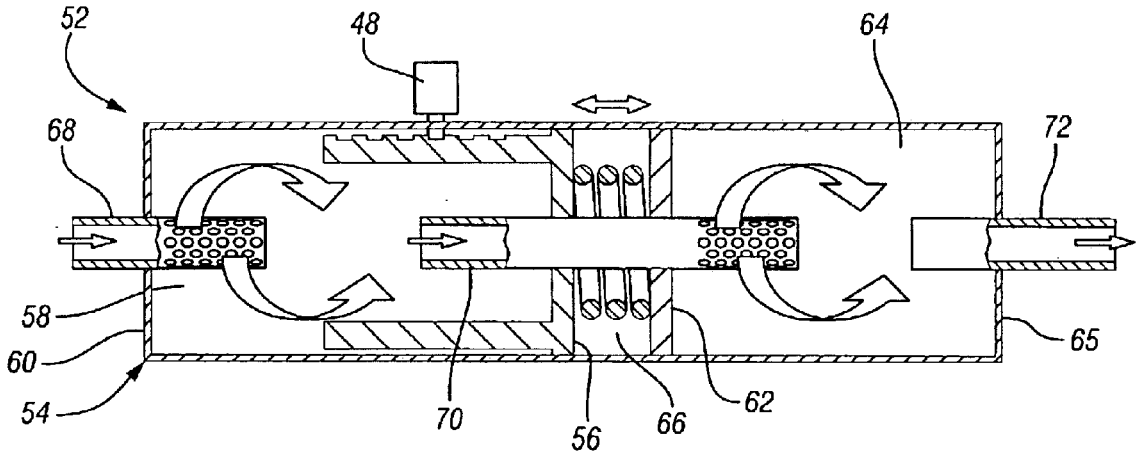
FIG. 3 is a similar view of a second embodiment of muffler according to the invention.

Referring now to FIG. 3 of the drawings, numeral 52 generally indicates an alternative embodiment of muffler having an adjustable resonance chamber. Muffler 52 is generally similar to muffler 10 except for the structures comprising the resonance chamber. Thus, the housing 54 and locking mechanism 48 are physically similar and operate in a similar manner to those of muffler 10.

Muffler 52 includes a slidable member 56 extending laterally across the housing 54 to create an adjustable resonance chamber 58 between an inlet end 60 of the housing and the slidable member 56. Adjacent the slidable member 56 is a partitioning wall 62 that extends laterally across the housing 54 to create a fixed resonance chamber 64 adjacent an outlet end 65 of the muffler 52. A biasing spring 66, is positioned between the partitioning wall 62 and the slidable member 56 to bias the slidable member 56 toward the inlet end 60 of the housing 54. An inlet pipe 68 extends axially through the inlet end 60 into the adjustable resonance chamber 58. An intermediate pipe 70 extends axially through the slidable member 56 and the partitioning wall 62 to connect the adjustable chamber 58 with the fixed chamber 64. An outlet pipe 72 extends through the housing outlet end 65 from the fixed chamber 64.

In operation, as exhaust enters the adjustable resonance chamber 58 the noise level is reduced by quarter wave resonant cancellation. As the engine speed increases, the flow of exhaust gas is increased, raising the exhaust pressure in the adjustable first resonance chamber 58. The increased pressure moves the slidable member 56 against spring 66 toward the partitioning wall 62 and changes the size and shape of the adjustable resonance chamber 58. As a result, the acoustic damping of the adjustable chamber is tuned to match the increased engine speed.

The exhaust gas travels from the adjustable resonance chamber 58 to the fixed resonance chamber 64 through the intermediate pipe 70. The fixed resonance chamber 70 further reduces exhaust noise. The muffled exhaust gas then exits the muffler through the outlet pipe 72 to the external environment at a reduced noise level.

Figure 4:
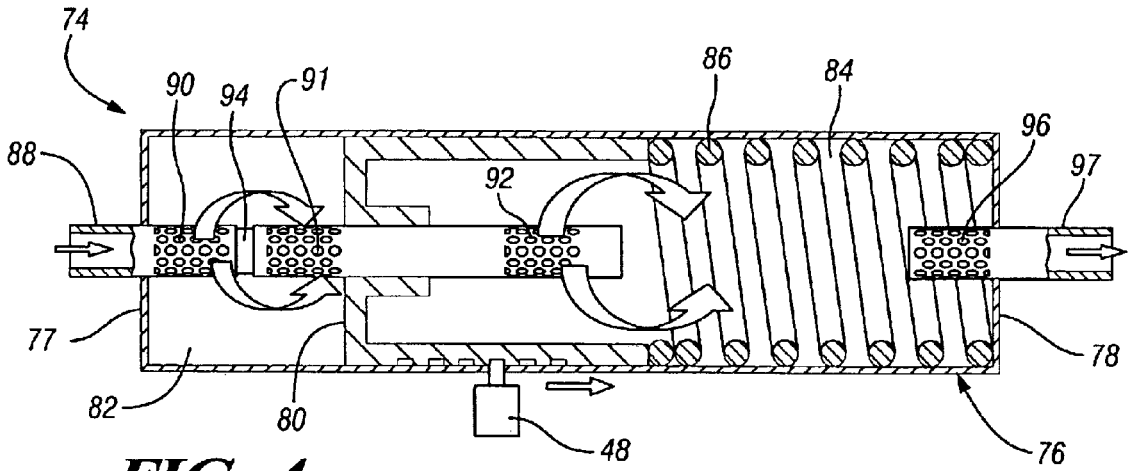
FIG. 4 is a similar view of a third embodiment.

Referring now to FIG. 4 of the drawings, numeral 74 generally indicates a third embodiment of muffler having an adjustable resonance chamber. Muffler 74 is generally similar to muffler 52 except for the structures comprising the resonance chamber. Thus, a housing 76 and locking mechanism 48, are physically similar and operate in a similar manner to those of muffler 52.

The housing 76 is an axially elongated body having inlet and outlet ends 77, 78. A slidable member 80 extends laterally across the housing to divide the interior into two adjustable resonance chambers 82, 84. The first resonance chamber 82 is located at the inlet end 77 of the housing 76. The second resonance chamber 84 is located at the outlet end 78 of the housing. A biasing spring 86 extends between the slidable member 80 and the outlet end 78 of the housing 76 to bias the slidable member 80 toward the inlet end 77 of the housing.

An inlet pipe 88 extends axially through the inlet end 77 of the housing 76 and the slidable member 80 into the second resonance chamber 84. The inlet pipe 92 has three sets of perforations 90, 91, 92 inside the housing to communicate with both the first resonance chamber 82 and the second resonance chamber 84. The inlet pipe 88 has a stop 94 extending across the pipe 88 to direct exhaust into the first resonance chamber 82 through the first set of perforations 90. Exhaust gas pressure waves pass through perforations 90 into the first resonance chamber 82 which acts as a quarter wavelength length resonator. With increasing engine speed increasing exhaust pressure in the first resonance chamber 82 urges the slidable member 80 toward the outlet end 77 of the housing 76 to vary tuning of the acoustics in the first resonance chamber 82 as a function of exhaust gas flow.

As a result, the first resonance chamber 82 increases in size while the second chamber 84 decreases in size. This allows the muffler to provide variable tuning for acoustic canceling of exhaust noise. The muffled exhaust gas from the first resonance chamber 82 flows back into the inlet pipe 88 through perforations 91. The inlet pipe 88 then carries the exhaust to the third set of perforations 92 where it is dispersed into the second resonance chamber 84 to be further muffled. Finally, the quieted exhaust gas in the second resonance chamber 84 flows out of the housing through perforations 96 in an on outlet pipe 97.

Figure 5:
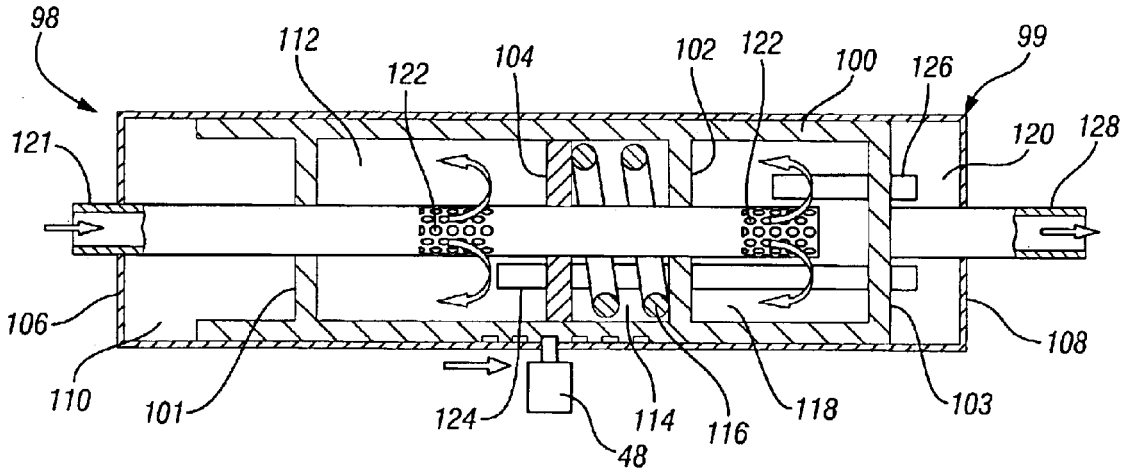
FIG. 5 is a similar view of a fourth embodiment.

Referring now to FIG. 5 of the drawings, numeral 98 generally indicates a fourth embodiment of muffler having an adjustable resonance chamber. Muffler 98 is generally similar to muffler 52 except for the structures comprising the resonance chamber. Thus, a housing 99, and locking mechanism 48 are physically similar and operate in a similar manner to those of muffler 52.

The interior of the muffler includes a stationary frame 100 having fixed partitioning walls 101, 102, 103. These cooperate with a movable piston 104 and inlet and outlet ends 106, 108 of the housing 99 to form a plurality of chambers. An inactive chamber 110 of fixed volume is formed adjacent the inlet end 106 of the housing 99. A variable volume resonance chamber, or first chamber 112, is located between fixed wall 101 and movable piston 104. A biasing chamber 114 encloses a biasing spring 116 acting between the fixed wall 102 and piston 104 to bias the piston toward the first chamber 112. A fixed volume resonance chamber 118 is formed between walls 102 and 103. Finally, a fixed volume outlet chamber 120 is located between wall 103 and the outlet end 108 of the housing.

An inlet pipe 121 extends through the inlet end 106, and the intervening walls to the second chamber 118 and includes perforations 122 communicating with both the first and second resonance chambers 112, 118. First and second collection tubes 124, 126 communicate the first chamber 112 and the second chamber 118, respectively with the outlet chamber 120. An outlet pipe 128 extends through the outlet end 108 to connect the outlet chamber 120 with the muffler exterior.

In operation exhaust gas from the engine is directed through the inlet pipe 121 and perforations 122 into the first resonance chamber 112 and the second chamber 118. As engine speed increases, exhaust pressure builds in the variable volume first chamber 112, forcing the movable piston 104 to move against the bias of spring 116 to increase the size of the first chamber 112. The increased size of chamber 112 adjusts the tuning of the resonance chamber 112 to reduce exhaust noise. The exhaust gas flows out from chamber 112 through the first collection pipe 124 into the outlet chamber 120.

Exhaust gas in the fixed volume chamber 118 is discharged through the second collection tube 126 into the outlet chamber 120. The exhaust gas collected in the outlet chamber 120 is exhausted from the muffler through the outlet pipe 128 which extends axially out of the housing.

Figure 6:
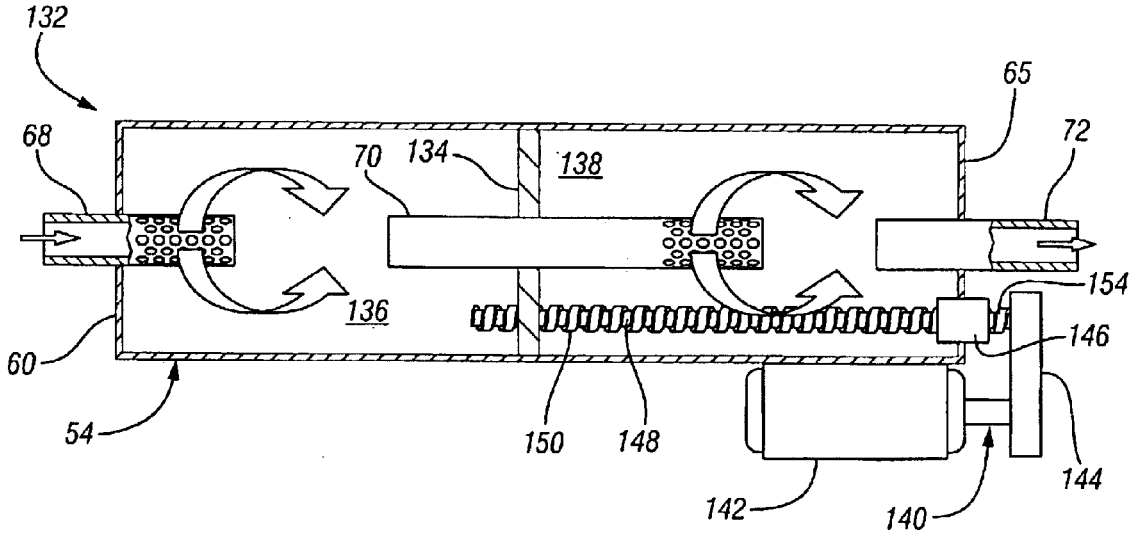
FIG. 6 is similar view of a fifth embodiment having and an electro-mechanical actuator.

Referring now to FIG. 6 of the drawings, numeral 132 generally indicates a fifth embodiment of muffler having an adjustable resonance chamber. Muffler 132 has a housing 54 which is generally similar to the housing of muffler 52 and includes an inlet end 60 and an outlet end 65.

A slidable member 134 extends laterally across the housing 54 to define a first adjustable resonance chamber 136 between an inlet end 60 and the slidable member 134. The slidably member also defines a second adjustable resonance chamber 138 between the outlet end 65 and the slidable member 134. An inlet pipe 68 extends axially through the inlet end 60 into the first resonance chamber 136. An intermediate pipe 70 extends axially through the slidable member 134 to connect the first adjustable chamber 136 with the second adjustable chamber 138. An outlet pipe 72 extends through the housing outlet end 65 from the second chamber 138.

An actuating mechanism 140 is mounted on the housing 54 and includes an electric motor 142, a drive mechanism 144, a guide bushing 146, and a threaded spindle 148 that threadably engages the slidable member 134. The bushing 146 guides the spindle through the housing 54 at the outlet end 65. The spindle 148 extends longitudinally through the bushing 146 and the second adjustable chamber 138 to engage the slidable member 134. Threads 150 on the spindle engage mating threads, not shown, in the slidable member 134 to move the slidable member longitudinally within the housing 54. An exterior portion 154 of the spindle 148 engages the drive mechanism 144, which is located on the exterior of the outlet end 65 of the housing 54. The electric motor 142 extends longitudinally along the exterior of the housing 54, toward the outlet end 65 where it connects with the drive mechanism 144.

In operation, electric motor 142 is actuated by suitable controls to operate the drive mechanism 144, causing the spindle 148 rotate in a desired direction. Rotation of the threaded spindle 148 drives the slidable member 134 longitudinally within the housing 54 to change the size and shape of the resonance chambers 136, 138. When the actuation mechanism 140 is stationary, it acts as a locking mechanism to prevent movement of the slidable member 134.

As exhaust enters the adjustable resonance chamber 136 the noise level is reduced by quarter wave resonant cancellation. As engine speed increases the actuation mechanism 140 is controlled to move the slidable member 134 to lengthen the first chamber 136 as needed to maintain it as a quarter wavelength resonator. Thus, the acoustic damping of the first adjustable chamber is tuned to match the increased engine speed.

The exhaust gas travels from the first resonance chamber 136 to the second resonance chamber 138 through the intermediate pipe 70. The second resonance chamber 138 further reduces exhaust noise. The muffled exhaust gas then exits the muffler through the outlet pipe 72 to the external environment at a reduced noise level.

The variable volume resonance chambers of the invention provide for broad band tuning of the muffler for maximum noise reduction over a desired range of engine speeds and operating conditions. The chambers may be expanded by the action of exhaust pressure on the slidable member, fixed at a desired volume by the locking mechanism and reduced or returned to their initial volumes by the biasing spring. Suitable actuating and control means may be used for actuating the locking mechanism. Alternatively, if desired, the slidable member may be actuated by mechanical devices controlled in response to various engine parameters.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A muffler for controlling vehicle engine exhaust noise, the muffler comprising:

a housing having a variable volume resonance chamber defined by a slidable member;

an inlet pipe extending into the housing and communicating with the resonance chamber;

an outlet pipe communicating with the resonance chamber and extending from tee housing, for discharging exhaust gas from the muffler; and positioning means operative in response to exhaust pressure to position the slidable member in the housing to vary the tuning of the resonance chamber.

2. A muffler as in claim 1 wherein the positioning means include:

a wall of the slidable member responsive to the force of inlet exhaust pressure to move the slidable member in the housing;

a biasing element biasing the slidable member against the force of inlet exhaust pressure; and a locking device connected with the housing and selectively engaging the slidable member.

3. A muffler as in claim 1 wherein movement of the slidable member adjusts the effective length of the resonance chamber.

4. A muffler as in claim 1 wherein the slidable member has multiple baffles extending longitudinally in the housing and the housing has at least one fixed baffle extending longitudinally and spaced between baffles of the slidable member to form exhaust flow channels that vary in length upon movement of the slidable member.

5. A muffler as in claim 4 wherein the outlet pipe has bypass ports controlled by movement of The slidable member to selectively allow exhaust gas to bypass some of the flow channels.

6. A muffler as in claim 1 wherein additional resonance chambers of varying lengths are connected together to conduct the exhaust gas.

7. A muffler as in claim 1 wherein the housing has at least one fixed resonance chamber.

8. A muffler as in claim 6 wherein intermediate pipes connect the resonance chambers.

9. A muffler as in claim 8 wherein the intermediate pipes have perforated portions.

10. A muffler as in claim 1 wherein a stop prevents the slidable member from closing the inlet.

11. A method of reducing engine noise, comprising the steps of;

providing a muffler having an housing including a resonance chamber defined by a slidable member; and actuating the slidable member with exhaust gas pressure to vary the length of the resonance chamber, thereby adjusting the resonance chamber in response to exhaust gas flow to provide optimum cancellation of exhaust noise.

12. A method as in claim 11 wherein movement of the slidable member maintains a quarter wavelength resonance in the resonance chamber.

13. A method as in claim 11 wherein movement of the slidable member alters the flow path of the exhaust gas to control exhaust gas flow restriction.

* * * * *